United States Patent [19]

Heumann

[11] Patent Number: 4,806,078

[45] Date of Patent: Feb. 21, 1989

[54] DEVICE FOR TRANSMITTING TORQUE TO BRITTLE IMPELLERS OF FLUID FLOW MACHINES

[75] Inventor: Anton Heumann, Nuremberg, Fed. Rep. of Germany

[73] Assignee: Klein, Schanzlin & Becker Aktiengesellschaft, Frankenthal/Pfalz, Fed. Rep. of Germany

[21] Appl. No.: 146,323

[22] Filed: Jan. 21, 1988

[30] Foreign Application Priority Data

Jan. 24, 1987 [DE] Fed. Rep. of Germany ..... 3702016

[51] Int. Cl.[4] ..... F04D 29/38

[52] U.S. Cl. ..... 416/186 R; 416/241 B; 415/212 R; 403/30; 403/404

[58] Field of Search ..... 415/200, 212 R, 213 R, 415/214; 416/186 R, 241 B, 214 R, 214 A; 403/30, 29, 404

[56] References Cited

U.S. PATENT DOCUMENTS

| | | | |
|---|---|---|---|
| 2,392,858 | 1/1946 | McMahan | 416/186 R |
| 2,401,206 | 5/1946 | Van Rijswijk | 416/186 R |
| 2,848,190 | 8/1958 | Barr | 416/185 |
| 3,149,574 | 9/1964 | Mill | 415/212 R |
| 4,176,519 | 12/1979 | Kronogard | 416/241 B |
| 4,479,735 | 10/1984 | Thompson et al. | 408/30 |

FOREIGN PATENT DOCUMENTS

| | | | |
|---|---|---|---|
| 360273 | 9/1922 | Fed. Rep. of Germany | 416/186 R |
| 2915292 | 10/1980 | Fed. Rep. of Germany | 416/241 B |
| 117098 | 9/1980 | Japan | 416/186 R |
| 632475 | 11/1949 | United Kingdom | 416/186 R |

*Primary Examiner*—Robert E. Garrett
*Assistant Examiner*—John T. Kwon
*Attorney, Agent, or Firm*—Peter K. Kontler

[57] ABSTRACT

A centrifugal pump wherein the back shroud of a brittle impeller of ceramic or glass is coupled to the radially outwardly extending disc of a metallic adapter whose hub receives torque from the pump shaft. The adapter has a flange which surrounds the peripheral surface of the impeller or it has a collar which surrounds a complementary collar of the back shroud. The arrangement is such that the coupling between the adapter and the impeller does not subject the impeller to any tensional or other stresses which would be likely to affect the integrity of the brittle impeller. The disc of the adapter is adjacent the rear side of the back shroud so that the adapter does not interfere with the flow of conveyed material to, in and from the impeller.

8 Claims, 1 Drawing Sheet

DEVICE FOR TRANSMITTING TORQUE TO BRITTLE IMPELLERS OF FLUID FLOW MACHINES

BACKGROUND OF THE INVENTION

The invention relates to fluid flow machines in general, and more particularly to improvements in means for transmitting torque from the driving element (such as a motor-driven shaft) to one or more impellers of a centrifugal pump or another fluid flow machine. Still more particularly, the invention relates to improvements in means for transmitting torque to brittle impellers.

German Offenlegungsschrift No. 29 15 292 discloses a ceramic rotor which is secured to a metallic shaft by means of two star-shaped discs each of which has a hub and a set of radially outwardly extending prongs or arms. The discs flank the rotor which is provided with slightly conical surfaces abutting the respective sets of prongs. These prongs are elastic and engage the respective surfaces of the rotor in stressed condition. At least one of the discs is form-lockingly connected with the rotor.

The purpose of the just described mounting of the rotor is to ensure that the rotor will be acted upon by compressive stresses but will be subjected to the action of negligible forces which could cause the development of tensional stresses, i.e., of stresses which cannot be readily withstood by a brittle material (such as a ceramic or glass). A drawback of the discs which are proposed in the Offenlegungsschrift is that their initial cost is substantial. Moreover, such discs can properly engage only a rotor which is of special design so that it can cause at least some stressing of the prongs and can be maintained in requisite form-locking engagement with one or both discs. Still further, at least one of the discs interferes with the flow of conveyed material toward, in and from the rotor if the latter constitutes an impeller. This holds true especially for the suction side of an impeller because the suction side is normally adjacent several indispensable or optional component parts of the pump, such as devices for engaging the periphery of the impeller.

OBJECTS AND SUMMARY OF THE INVENTION

An object of the invention is to provide a novel and improved device which can connect a brittle impeller to a driving element without interfering with the flow of conveyed material.

Another object of the invention is to provide a simple, compact and inexpensive adapter which can secure a brittle impeller to a pump shaft and occupies little room in a fluid flow machine.

A further object of the invention is to provide a fluid flow machine which embodies one or more adapters of the above outlined character.

An additional object of the invention is to provide a adapter which can be coupled to an impeller in such a way that the impeller is subjected to negligible tensional and/or other stresses which would be likely to result in breakage of an impeller consisting of glass or a ceramic substance.

Another object of the invention is to provide a novel and improved method of mounting brittle impellers on the shafts of centrifugal pumps or other fluid flow machines.

The invention is embodied in a fluid flow machine, such as a centrifugal pump. The fluid flow machine comprises a rotary impeller having a back shroud with a peripheral surface, and an adapter which connects the impeller to a driving component, such as the pump shaft. The adapter includes means for engaging the impeller in the region of the peripheral surface of the back shroud in such a way that the impeller is not subjected to any, or is subjected to negligible, tensional stresses. This is important when the back shroud or the entire impeller contains or consists of a brittle material (such as glass or a ceramic). The adapter preferably comprises or consists of a ductile material, such as a suitable metallic substance.

The adapter can further include a hub which can be non-rotatably mounted on the shaft of a centrifugal pump, and a disc which is adjacent the back shroud. The aforementioned engaging means is provided on the disc. Such engaging means can comprise a flange or an analogous member which surrounds at least a portion of the peripheral surface of the back shroud. Alternatively, the back shroud can be provided with a first collar and the disc of the adapter can be provided with a second collar, which constitutes or forms part of the engaging means and surrounds or is surrounded by the first collar. The disc can be in large-area surface-to-surface contact with the back shroud; alternatively, the back shroud can contact only the hub and the engaging means of the adapter.

The novel features which are considered as characteristic of the invention are set forth in particular in the appended claims. The improved fluid flow machine itself, however, both as to its construction and the mode of mounting the impeller on its adapter, together with additional features and advantages thereof, will be best understood upon perusal of the following detailed description of certain specific embodiments with reference to the accompanying drawing.

DESCRIPTION OF THE PREFERRED EMBODIMENTS

Figure 1:
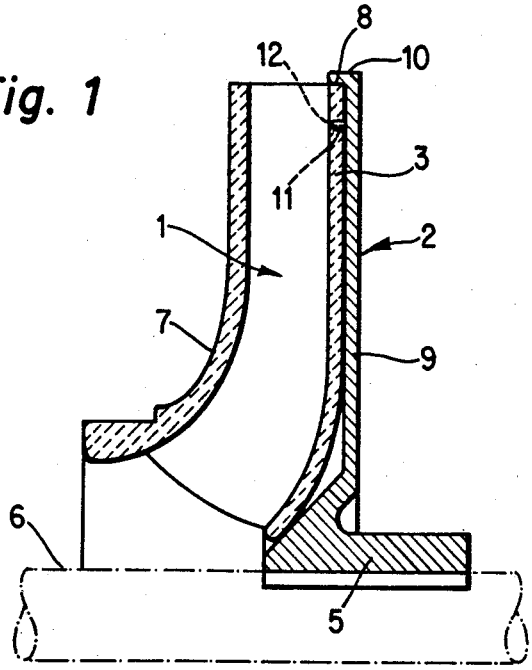
FIG. 1 is a fragmentary schematic axial sectional view of a portion of a fluid flow machine wherein the back shroud of the impeller is affixed to the adapter in accordance with a first embodiment of the invention, the shaft which serves to rotate the impeller by way of the adapter being indicated by phantom lines.

FIG. 1 shows a portion of a centrifugal pump which comprises a motor-driven shaft 6, a closed impeller 1 which spacedly surrounds the shaft and is made of a brittle material (e.g., a ceramic or glass), and an adapter 2 which serves to transmit torque between the impeller 1 and the shaft 6. The impeller 1 includes an inner coverplate or back shroud 3 and a front or outer coverplate 7. The peripheral surface 8 of the back shroud 3 is surrounded by a flange-like engaging portion 10 of a disc 9 forming part of the adapter 2 and being integral with a hub 5 which can be provided with internal splines cooperating with axially parallel teeth of the shaft 6 in order to ensure that the shaft 6 and the adapter 2 invariably rotate as a unit. The adapter 2 is made of a ductile material, preferably of a metallic material, and the adapter is configurated and mounted in such a way that it can subject the impeller 1 to permissible compressive stresses but only to negligible tensional or any other stresses of the nature which cannot be readily withstood by a brittle material. The flange-like engaging portion 10 can be replaced with a set of circumferentially spaced apart discrete claws which can extend into complementary recesses or notches in the peripheral surface 8 to even more reliably ensure that the impeller 1 will be compelled to share all angular movements of the shaft 6 and adapter 2. Alternatively, the engaging portion 10 can be provided with a set of radially inwardly extending claws or prongs (one indicated by broken lines, as at 11) which are received in complementary recesses 12 provided in the peripheral surface 8 of the back shroud 3 to establish a combined form-locking and force-locking connection between the impeller and the adapter.

The engaging portion 10 and/or its claws 11 exert a certain pressure upon the peripheral surface 8 of the back shroud 3 so as to properly center and entrain the impeller 1 when the shaft 6 rotates. The forces which act at the periphery of the back shroud 3 are relatively small so that they cannot affect the integrity of the impeller 1, even if the latter is made entirely of a brittle material, such as glass or a ceramic substance. The transmission of torque between the hub 5 of the adapter 2 and the shaft 6 does not affect the forces acting between the adapter and the impeller 1.

Figure 2:
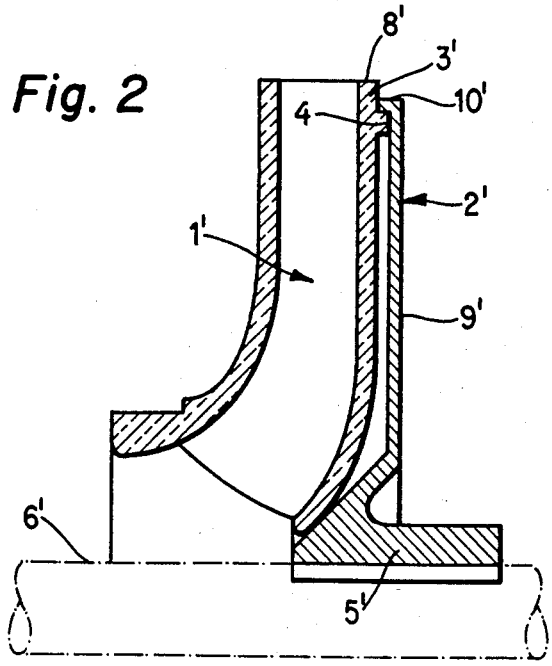
FIG. 2 is a similar fragmentary schematic axial sectional view but showing a modified impeller and a modified adapter.

In FIG. 1, the disc 9 of the adapter 2 is in large surface-to-surface contact with the outer side of the back shroud 3. FIG. 2 shows an embodiment wherein the disc 9' of the adapter 2' is spaced apart from the outer side of the back shroud 3' of the impeller 1' save for the contact between an engaging and entraining collar 10' at the periphery of the disc 9' and a collar 4 at the outer side of the back shroud 3' close to the peripheral surface 8'. The manner in which the hub 5' of the adapter 2' is mounted on the shaft 6' is or can be the same as described in connection with FIG. 1. The area of contact between the adapter 2' and the impeller 1' is limited to that between the abutting surfaces of the collars 10', 4 and those of the back shroud 3' and hub 5'.

The improved adapter can be used in single-stage or multi-stage fluid flow machines, and it can be impellers.

An important advantage of the improved adapter is its simplicity. In addition, the adapter does not interfere with the flow of fluid media toward, in or away from the impeller. The hub 5 or 5' can be designed to enable the respective adapter to mount a brittle impeller in an existing fluid flow machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a fluid flow machine, such as a centrifugal pump, the combination of a rotary impeller having a back shroud and containing a brittle material, and an adapter for connecting the impeller to a rotary component, such as a pump shaft, said back shroud having a peripheral surface and said adapter containing a ductile material and including means for engaging said back shroud in the region of said peripheral surface.

2. The combination of claim 1, wherein said brittle material is selected from the group consisting of ceramic and glass and said ductile material is a metallic substance.

3. The combination of claim 1, wherein said adapter further includes a hub and a disc adjacent said back shroud, said engaging means being provided on said disc.

4. The combination of claim 1, wherein said engaging means comprises a member which surrounds at least a portion of the peripheral surface of said back shroud.

5. The combination of claim 1, wherein said back shroud has a first collar and said engaging means comprises a second collar, one of said collars surrounding the other of said collars.

6. The combination of claim 1, wherein said impeller a closed impeller.

7. The combination of claim 1, wherein said adapter a disc which is in surface-to-surface contact with said back shroud.

8. The combination of claim 1, wherein said adapter includes a disc which is adjacent to but spaced apart from said back shroud.

* * * * *